US009891008B2

(12) United States Patent
Shikazono et al.

(10) Patent No.: US 9,891,008 B2
(45) Date of Patent: Feb. 13, 2018

(54) HEAT EXCHANGER

(75) Inventors: Naoki Shikazono, Tokyo Metropolis (JP); Kentaro Fukuda, Kariya (JP)

(73) Assignee: THE UNIVERSITY OF TOKYO, Tokyo (JP)

( * ) Notice: Subject to any disclaimer, the term of this patent is extended or adjusted under 35 U.S.C. 154(b) by 688 days.

(21) Appl. No.: 12/449,033

(22) PCT Filed: Jan. 22, 2008

(86) PCT No.: PCT/JP2008/050778
§ 371 (c)(1),
(2), (4) Date: Jul. 21, 2009

(87) PCT Pub. No.: WO2008/090872
PCT Pub. Date: Jul. 31, 2008

(65) Prior Publication Data

US 2010/0071886 A1 Mar. 25, 2010

(30) Foreign Application Priority Data

Jan. 25, 2007 (JP) ..... 2007-015538

(51) Int. Cl.
*F28D 1/02* (2006.01)
*F28D 1/04* (2006.01)
(Continued)

(52) U.S. Cl.
CPC ..... *F28F 1/32* (2013.01); *F28F 1/126* (2013.01); *F28D 1/05383* (2013.01)

(58) Field of Classification Search
USPC ..... 165/151, 152
See application file for complete search history.

(56) References Cited

U.S. PATENT DOCUMENTS 1,553,093 A * 9/1925 Modine ..... 165/151
2,006,649 A * 7/1935 Modine ..... 165/146
(Continued)

FOREIGN PATENT DOCUMENTS

CN 1124057 A 6/1996
GB 2 027 533 A 2/1980
(Continued)

OTHER PUBLICATIONS

Y. Suzue et al., "High Performance Heat Exchanger With Oblique-Wave Walls," Heat Exchangers, Jan. 1, 2006, 8 pages.
(Continued)

*Primary Examiner* — Grant Moubry
*Assistant Examiner* — Jason Thompson
(74) *Attorney, Agent, or Firm* — Oliff PLC

(57) ABSTRACT

Each fin 30 is designed to have continuous lines of wave crests 34 and continuous lines of wave troughs 36 arranged at a preset angle in a specific angle range of 10 degrees to 60 degrees relative to the main stream of the air flow and symmetrically folded back about folding lines of a preset folding interval W along the main stream of the air flow. A ratio (a/p) of an amplitude 'a' of a waveform including one wave crest 34 and one adjacent wave trough 36 to a fin pitch 'p' satisfies a relation of $1.3\times Re^{-0.5}<a/p<0.2$. A ratio (W/z) of the folding interval W to a wavelength 'z' of the waveform satisfies a relation of $0.25<W/z<2.0$. A ratio (r/z) of a radius of curvature 'r' at a top of the wave crest 34 or at a bottom of the wave trough 36 to the wavelength 'z' of the waveform satisfies a relation of $0.25<r/z$. The continuous lines of the wave crests 34 and the continuous lines of the wave troughs 36 are arranged to have an angle of inclination a of not less than 25 degrees at a cross section of the waveform. This arrangement effectively improves the heat
(Continued)

transfer coefficient of a heat exchanger and thereby allows effective size reduction of the heat exchanger.

8 Claims, 6 Drawing Sheets

(51) Int. Cl.

| | |
|---|---|
| ***F28F 1/32*** | (2006.01) |
| ***F28F 1/12*** | (2006.01) |
| *F28D 1/053* | (2006.01) |

(56) References Cited

U.S. PATENT DOCUMENTS

| | | | | |
|---|---|---|---|---|
| 3,183,963 | A * | 5/1965 | Mondt | 165/10 |
| 3,298,432 | A * | 1/1967 | Przyborowski | 165/153 |
| 3,578,264 | A * | 5/1971 | Kuethe | B64C 21/10 181/220 |
| 3,645,330 | A * | 2/1972 | Albright et al. | 165/151 |
| 3,741,285 | A | 6/1973 | Kuethe | |
| 3,963,810 | A * | 6/1976 | Holmberg et al. | 261/112.2 |
| 4,548,766 | A * | 10/1985 | Kinney et al. | 261/112.2 |
| 4,958,681 | A * | 9/1990 | Kadle | 165/151 |
| 5,401,321 | A * | 3/1995 | Hugo et al. | 134/11 |
| 5,501,270 | A * | 3/1996 | Young et al. | 165/151 |
| 5,511,610 | A * | 4/1996 | Lu | 165/153 |
| 5,623,989 | A * | 4/1997 | Kroger | 165/152 |
| 5,775,413 | A | 7/1998 | Kawanabe et al. | |
| 6,187,274 | B1 * | 2/2001 | Nilsson | B01J 35/04 422/177 |
| 6,805,193 | B2 * | 10/2004 | Hu et al. | 165/181 |
| 6,942,024 | B2 * | 9/2005 | Nies | 165/152 |
| 7,143,822 | B2 * | 12/2006 | Wisniewski | 165/140 |
| 7,475,719 | B2 * | 1/2009 | Derosier et al. | 165/151 |
| 2002/0066554 | A1 * | 6/2002 | Oh et al. | 165/179 |
| 2002/0162646 | A1 * | 11/2002 | Haasch et al. | 165/109.1 |
| 2004/0177949 | A1 * | 9/2004 | Shimoya et al. | 165/152 |
| 2007/0017633 | A1 * | 1/2007 | Tonkovich | B01F 5/0611 156/300 |
| 2008/0264098 | A1 * | 10/2008 | Shikazono et al. | 62/513 |
| 2012/0318485 | A1 * | 12/2012 | Yabe et al. | 165/152 |

FOREIGN PATENT DOCUMENTS

| | | |
|---|---|---|
| JP | A 1-219497 | 9/1989 |
| JP | B2-07-31029 | 4/1995 |
| JP | A-1997-113068 | 5/1997 |
| JP | A-1998-185475 | 7/1998 |
| JP | A 2000-193389 | 7/2000 |
| JP | A 2001-167782 | 6/2001 |
| JP | A 2003-161588 | 6/2003 |
| JP | A-2006-138503 | 6/2006 |

OTHER PUBLICATIONS

Apr. 27, 2012 European Search Report issued in European Application No. 08703625.7.

* cited by examiner

HEAT EXCHANGER

TECHNICAL FIELD

The present invention relates to a heat exchanger, and more specifically pertains to a heat exchanger designed to perform heat exchange by making a fluid flow between at least two opposed heat transfer members.

BACKGROUND ART

One proposed heat exchanger is an in-vehicle corrugated fin tube heat exchanger including multiple flat tubes arranged to make a coolant flow and corrugated fins attached between adjacent pairs of the multiple flat tubes (see, for example, Japanese Patent Laid-Open No. 2001-167782). One proposed structure of a cross fin tube heat exchanger uses multiple slit fins with thin slits formed therein (see, for example, Japanese Patent Laid-Open No. 2003-161588). Another proposed structure of the cross fin tube heat exchanger uses wavy fins with wave crests and wave troughs formed in a direction perpendicular to the direction of the air flow (see, for example, Japanese Patent Laid-Open No. 2000-193389). Still another proposed structure of the cross fin tube heat exchanger uses V-shaped wavy fins having wave crests and wave troughs arranged in a V shape at an angle of 30 degrees relative to the direction of the air flow (for example, Japanese Patent Laid-Open No. H01-219497). These proposed techniques adopt various shapes of fins with the purpose of accelerating heat transfer in the fin tube heat exchangers.

DISCLOSURE OF THE INVENTION

In the prior art heat exchanger with the slit fins or in the prior art heat exchanger with the wavy fins, however, while the slits or the wave crests and wave troughs improve the heat transfer coefficient, the resulting projections or the resulting partial cutting and folding may cause separation of the air flow or a local speed multiplication to increase the ventilation resistance rather than the heat transfer coefficient. In application of such a heat exchanger for an evaporator in refrigeration cycles, the water vapor content in the air may adhere in the form of dew or frost to the heat exchanger and clog the slits or the waveforms with condensed water or frost to interfere with the smooth air flow. In the prior art heat exchanger with the V-shaped wavy fins, there is no separation of the air flow or local speed multiplication caused by the projections or the partial cutting and folding. The V-shaped wave crests and wave troughs on the V-shaped wavy fins may, however, have the low heat transfer coefficient or the high ventilation resistance.

By taking into account the problems of the prior art techniques discussed above, there would thus be a demand for forming an appropriate shape of wave crests and wave troughs in the V-shaped wavy fins of the heat exchanger, so as to provide a high-performance, small-sized heat exchanger having high efficiency of heat exchange.

The present invention accomplishes at least part of the demand mentioned above and the other relevant demands by variety of configurations and arrangements discussed below.

According to one aspect, the invention is directed to a heat exchanger configured to perform heat exchange by making a fluid flow between at least two opposed heat transfer members. Each of the at least two opposed heat transfer members is structured to have a heat transfer plane located to make the fluid flow thereon and equipped with a wave crest line and an adjacent wave trough line formed thereon. The wave crest line and the wave trough line are arranged to have a preset angle in a specific angle range of 10 degrees to 60 degrees relative to a main stream of the fluid flow and are symmetrically folded back about folding lines arranged at a preset interval along the main stream of the fluid flow. The wave crest line and the adjacent wave trough line are arranged to satisfy an inequality of $1.3\times Re-0.5<a/p<0.2$. Here 'a' denote an amplitude of a waveform including one wave crest of the wave crest line and one wave trough of the adjacent wave trough line, 'p' denotes a pitch as an interval between adjacent heat transfer planes of the at least two opposed heat transfer members, and 'Re' denotes a Reynolds number defined by a bulk flow rate and the pitch 'p'.

In the heat exchanger according to this aspect of the invention, the at least two opposed heat transfer members are structured to have the wave crest line and the wave trough line satisfying the inequality given above. The vortexes of the secondary flows generated in the course of the fluid flow can thus function as a secondary flow component effective for acceleration of heat transfer without being affected by the heat transfer planes of the opposed heat transfer members. This gives the high-performance, small-sized heat exchanger having the high efficiency of heat exchange.

In one preferable application of the heat exchanger according to the above aspect of the invention, each of the at least two opposed heat transfer members is structured to have the wave crest line and the wave trough line arranged to satisfy an inequality of $0.25<W/z<2.0$. Here 'W' denotes the preset interval of the folding lines and 'z' denotes a wavelength of the waveform including the wave crest and the wave trough. This arrangement effectively controls an increase in ratio of a moving distance of the secondary flow component in a spanwise direction to a moving distance of the secondary flow component in a normal direction perpendicular to the heat transfer planes of the at least two opposed heat transfer members and keeps the large secondary flow component effective for acceleration of heat transfer. This gives the high-performance, small-sized heat exchanger having the higher efficiency of heat exchange.

In another preferable application of the heat exchanger according to the above aspect of the invention, each of the at least two opposed heat transfer members is structured to have the wave crest line and the wave trough line arranged to satisfy an inequality of $0.25<r/z$. Here 'r' denotes a radius of curvature at a top of the wave crest and/or at a bottom of the wave trough in the waveform and 'z' denotes the wavelength of the waveform including the wave crest and the wave trough. This arrangement effectively controls a local speed multiplication of the flow climbing over the wave crests and thereby prevents an increase of the ventilation resistance. This gives the high-performance, small-sized heat exchanger having the higher efficiency of heat exchange.

In still another preferable application of the heat exchanger according to the above aspect of the invention, the wave crest line and the adjacent wave trough line formed on each of the at least two opposed heat transfer members are arranged to have an angle of inclination of not less than 25 degrees on a cross section of the waveform including the wave crest and the wave trough. This arrangement enhances the secondary flow component along the wave crests and the wave troughs. The enhanced secondary flow component leads to generation of effective secondary flows having contribution to the heat transfer and increases the area of an effective region for heat transfer of the inclined surface on the cross section of the waveform including the wave crest and the wave trough. This gives the high-performance, small-sized heat exchanger having the higher efficiency of heat exchange.

In another preferable application of the heat exchanger according to the above aspect of the invention, each of the at least two opposed heat transfer members includes multiple heat transfer sectional members parted at plural planes substantially perpendicular to the main stream of the fluid flow. This arrangement enhances the secondary flows effective for acceleration of the heat transfer and blocks development of a boundary layer at the plural planes of separation, so as to attain the high thermal conductivity. This gives the high-performance, small-sized heat exchanger having the higher efficiency of heat exchange.

In one preferable embodiment of the invention, the heat exchanger includes multiple heat transfer tubes arranged in parallel to one another as a pathway of a heat exchange medium. The at least two opposed heat transfer members are formed as multiple fin members attached to the multiple heat transfer tubes such as to be arranged perpendicular to the multiple heat transfer tubes in a heat exchangeable manner and to be overlapped in parallel to one another at a preset interval. This gives the high-performance, small-sized fin tube heat exchanger having the higher efficiency of heat exchange.

BEST MODES OF CARRYING OUT THE INVENTION

Figure 1:
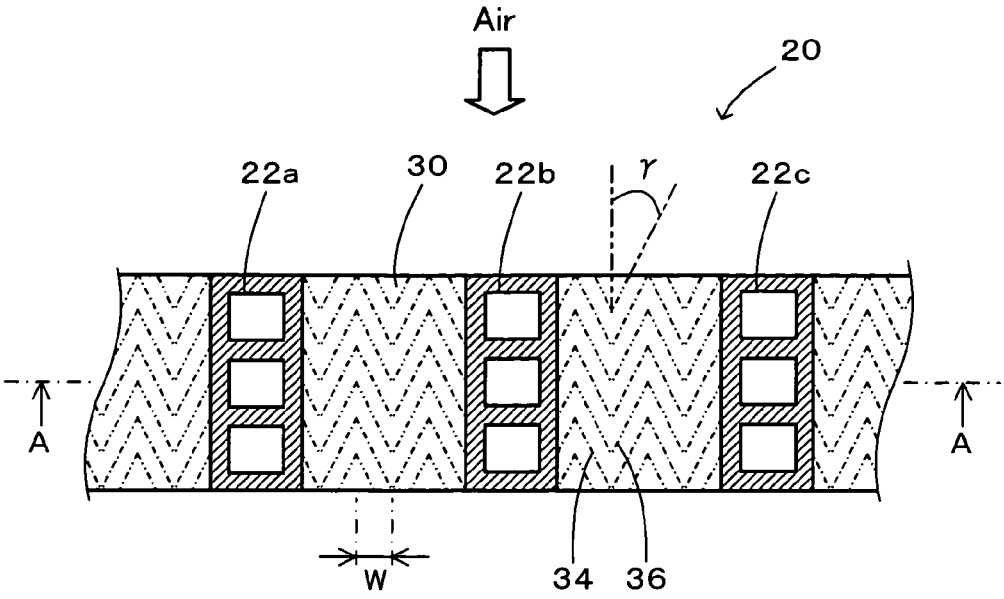
FIG. 1 is a schematic diagram illustrating the configuration of a corrugated fin tube heat exchanger 20 in one embodiment of the invention.
Figure 2:
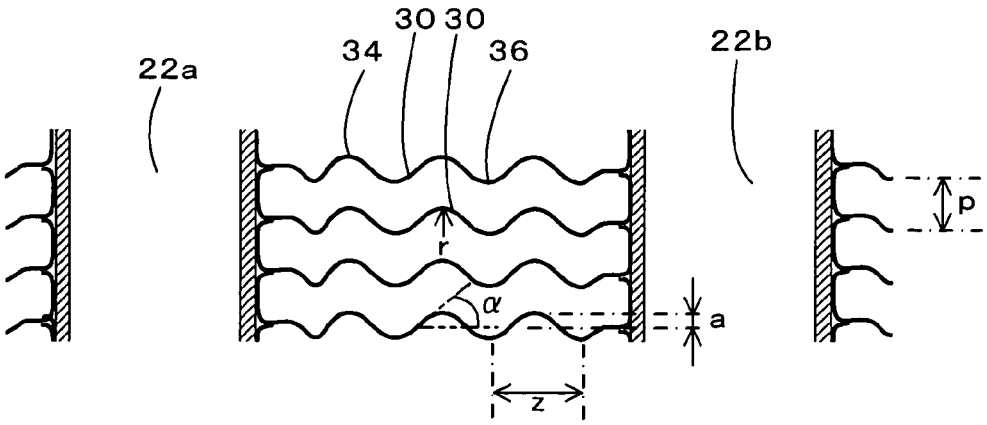
FIG. 2 is a sectional view showing an A-A cross section of the corrugated fin tube heat exchanger 20 of FIG. 1.

One mode of carrying out the invention is discussed below as a preferred embodiment with reference to the accompanied drawings. FIG. 1 is a schematic diagram showing the configuration of a corrugated fin tube heat exchanger 20 in one embodiment of the invention. FIG. 2 is a sectional view showing an A-A cross section of the corrugated fin tube heat exchanger 20 of FIG. 1. The enlarged cross section of FIG. 2 covers a range from one heat transfer tube 22*a* to another heat transfer tube 22*b*. As illustrated, the corrugated fin tube heat exchanger 20 of the embodiment includes multiple heat transfer tubes 22*a* to 22*c* arranged in parallel to one another as a pathway of a heat exchange medium and multiple fins 30 arranged substantially perpendicular to the multiple heat exchange tubes 22*a* to 22*c*.

The multiple heat exchange tubes 22*a* through 22*c* are arranged to be in parallel to one another and substantially perpendicular to the air flow for cooling to make bypass flows or split flows of the heat exchange medium, for example, a cooling liquid like cooling water or cooling oil or a coolant used for refrigeration cycles.

As shown in FIGS. 1 and 2, the multiple fins 30 are structured as multiple corrugated flat plate members. Each of the fins 30 is formed to have multiple continuous lines of wave crests (convexes) 34 shown by one-dot chain lines in FIG. 1 and multiple continuous lines of wave troughs (concaves) 36 shown by two-dot chain lines in FIG. 1 and arranged alternately with the continuous lines of the wave crests 34. The fins 30 are attached to the heat transfer tubes 22*a* to 22*c* such as to be arranged substantially perpendicular to the flow direction of the heat exchange medium flowing through the heat transfer tubes 22*a* to 22*c* and substantially parallel to one another at equal intervals. In the corrugated fin tube heat exchanger 20 of the embodiment, the multiple heat transfer tubes 22*a* to 22*c* in combination with the multiple fins 30 constitute an upper air inflow section and a lower air outflow section as shown in FIG. 1. The pathway of the air is accordingly formed between the respective heat transfer tubes 22*a* to 22*c*.

Figure 3:
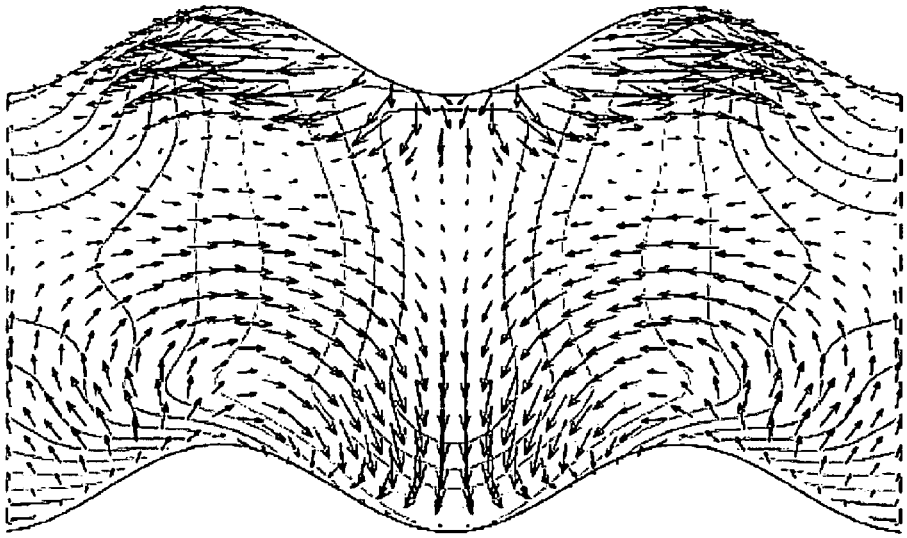
FIG. 3 is an explanatory view showing isothermal lines with secondary flows of the air generated on a corrugated flat plate by introduction of a low flow-rate, homogeneous flow of the air onto the corrugated flat plate.

Each of the fins 30 is designed to have the multiple continuous lines of the wave crests 34 and the multiple continuous lines of the wave troughs 36 (respectively shown by the one-dot chain lines and the two-dot chain lines), which are arranged to have a preset angle $\gamma$ (for example, 30 degrees) in a specific angle range of 10 degrees to 60 degrees relative to the main stream of the air flow. The continuous lines of the wave crests 34 and the continuous lines of the wave troughs 36 are symmetrically folded back about folding lines (non-illustrated lines of connecting flexion points of the one-dot chain lines with the two-dot chain lines of FIG. 1) arranged at a preset interval (folding interval) W along the main stream of the air flow. The effective secondary flows of the air can be generated by this arrangement of the fins 30 where the multiple continuous lines of the wave crests 34 and the multiple continuous lines of the wave troughs 36 (shown by the one-dot chain lines and the two-dot chain lines) are arranged at the preset angle $\gamma$ in the specific angle range of 10 degrees to 60 degrees relative to (the main stream of) the air flow. FIG. 3 shows isothermal lines with secondary flows of the air (shown by arrows) generated on a corrugated flat plate by introduction of a low flow-rate, homogeneous flow of the air onto the corrugated flat plate. As illustrated, strong secondary flows of the air are generated in the presence of the wave crests 34 and the wave troughs 36. There is accordingly a significant temperature gradient in a neighborhood of the wall face. In the structure of the embodiment, the multiple continuous lines of the wave crests 34 and the multiple continuous lines of the wave troughs 36 (respectively shown by the one-dot chain lines and the two-dot chain lines) are arranged to have the angle γ of 30 degrees relative to the main stream of the air flow. This arrangement aims to generate the effective secondary flows of the air. The excessively small angle γ fails to generate the effective secondary flows of the air. The excessively large angle γ, on the other hand, undesirably interferes with the smooth air flow going along the wave crests 34 and the wave troughs 36 and causes separation of the air flow or a local speed multiplication of the air flow, thus increasing the ventilation resistance. In order to generate the effective secondary flows of the air, the angle γ should be an acute angle and is preferably in a range of 10 degrees to 60 degrees, more preferably in a range of 15 degrees to 45 degrees, and most preferably in a range of 25 degrees to 35 degrees. The structure of this embodiment accordingly adopts 30 degrees for the angle γ. In the condition of the low air flow, the main stream of the air flow on the fin 30 with the wave crests 34 and the wave troughs 36 is kept substantially equivalent to the main stream of the air flow on a simple flat plate without the wave crests 34 and the wave troughs 36, while the effective secondary flows of the air are generated in the presence of the wave crests 34 and the wave troughs 36. In the structure of the embodiment, the angle γ is fixed to 30 degrees. The angle γ is, however, not necessarily fixed but may be varied to draw curved continuous lines of the wave crests 34 and curved continuous lines of the wave troughs 36.

In the corrugated fin tube heat exchanger 20 of the embodiment, each fin 30 is designed to have an amplitude-to-pitch ratio (a/p) satisfying Inequality (1) given below:

$$1.3\times\mathrm{Re}-0.5<a/p<0.2 \quad (1)$$

Figure 4:
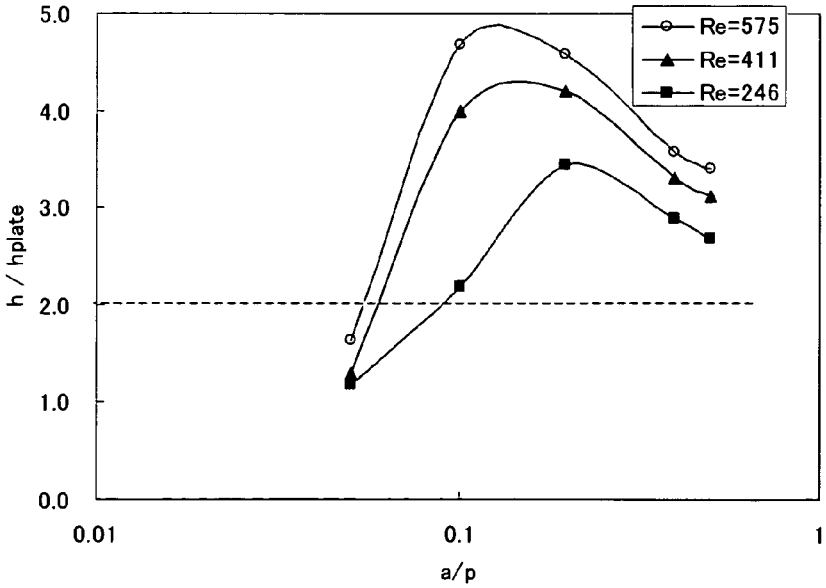
FIG. 4 is a graph showing a computation result of variations in improvement rate (h/hplate) of a heat transfer coefficient against an amplitude-to-pitch ratio (a/p) with regard to various values of a Reynolds number Re.
Figure 5:
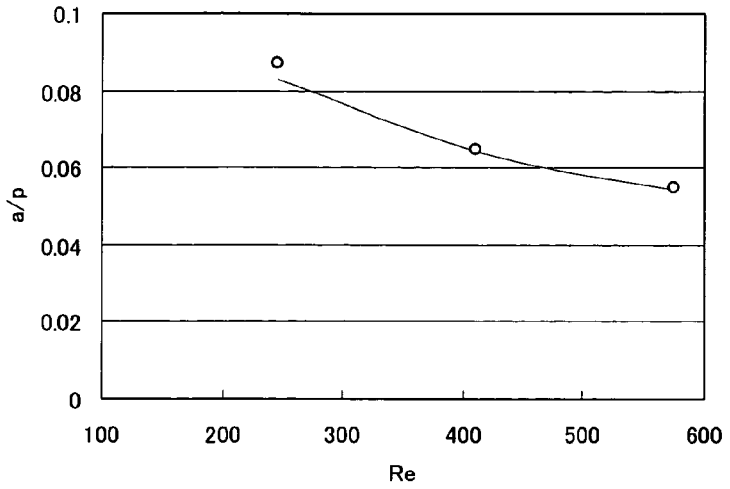
FIG. 5 is a graph showing a computation result of a variation in amplitude-to-pitch ratio (a/p) against the Reynolds number Re to give a heat transfer coefficient of not less than double the heat transfer coefficient of a comparative example.
Figure 6:
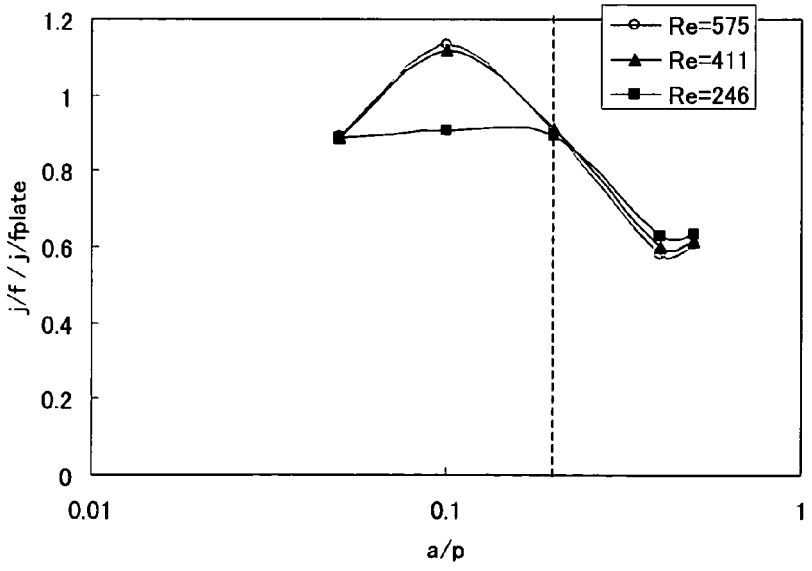
FIG. 6 is a graph showing a computation result of variations in improvement rate [(j/f)/(j/fplate)] of a heat transfer-to-friction ratio (j/f) as a ratio of the Colburn j-factor to a ventilation-relating friction coefficient f against the amplitude-to-pitch ratio (a/p) with regard to various values of the Reynolds number Re.

The amplitude-to-pitch ratio (a/p) represents a ratio of an amplitude 'a' of a waveform including one wave crest 34 and one adjacent wave trough 36 (see FIG. 2) to a fin pitch 'p' as an interval of the adjacent fins 30 (see FIG. 2). In Inequality (1), 'Re' denotes a Reynolds number and is expressed by Re=up/ν, wherein 'u', 'p', and 'ν' respectively denote a bulk flow rate, the fin pitch, and a dynamic coefficient of viscosity. The left side of Inequality (1) is based on the computation result of an improvement rate (h/hplate) that is not lower than 2.0 in a range of the amplitude-to-pitch ratio (a/p) of greater than 1.3×Re−0.5. The improvement rate (h/hplate) is computed as a ratio of a heat transfer coefficient 'h' of the fin 30 of the embodiment with waveforms of the wave crests 34 and the wave troughs 36 to a heat transfer coefficient 'hplate' of a flat plate fin of a comparative example without such waveforms. FIG. 4 is a graph showing a computation result of variations in improvement rate (h/hplate) of the heat transfer coefficient against the amplitude-to-pitch ratio (a/p) with regard to various values of the Reynolds number Re. FIG. 5 is a graph showing a computation result of a variation in amplitude-to-pitch ratio (a/p) against the Reynolds number Re to give a heat transfer coefficient of not less than double the heat transfer coefficient of a comparative example. The computation result of FIG. 4 suggests the presence of an optimum amplitude-to-pitch ratio (a/p) for each value of the Reynolds number Re. The left side of Inequality (1) is introduced from the computation result of FIG. 5. The right side of Inequality (1) is based on the computation result of good heat transfer performance with restriction of the influence of the increasing ventilation resistance in a range of the amplitude-to-pitch ratio (a/p) of smaller than 0.2. FIG. 6 is a graph showing a computation result of variations in improvement rate [(j/f)/(j/fplate)] given as a ratio of a heat transfer-to-friction ratio (j/f) of the fin 30 of the embodiment with waveforms of the wave crests 34 and the wave troughs 36 to a heat transfer-to-friction ratio (j/fplate) of the flat plate fin of the comparative example against the amplitude-to-pitch ratio (a/p) with regard to various values of the Reynolds number Re. The heat transfer-to-friction ratio (j/f) is given as a ratio of a Colburn j-factor to a ventilation-relating friction coefficient 'f'. The Colburn j-factor is a dimensionless number of the heat transfer coefficient. The heat transfer-to-friction ratio (j/f) is accordingly a ratio of the heat transfer performance to the ventilation resistance. The greater value of the heat transfer-to-friction ratio (j/f) indicates the higher performance of the heat exchanger. As clearly understood from the graph of FIG. 6, the improvement rate [(j/f)/(j/fplate)] of the heat transfer-to-friction ratio is not lower than 0.8 in the condition of the amplitude-to-pitch ratio (a/p) of not greater than 0.2. In the condition of the amplitude-to-pitch ratio (a/p) of greater than 0.2, the increasing ventilation resistance has the significant influence and undesirably lowers the performance of the heat exchanger. The amplitude 'a' of the waveform is not necessarily fixed but may be varied as long as the overall average of the amplitude-to-pitch ratio (a/p) satisfies Inequality (1) given above.

In the corrugated fin tube heat exchanger 20 of the embodiment, each fin 30 is designed to have an interval-to-wavelength ratio (W/z) in a range of greater than 0.25 and less than 2.0 as shown by Inequality (2) given below:

$$0.25<W/z<2.0 \quad (2)$$

Figure 7:
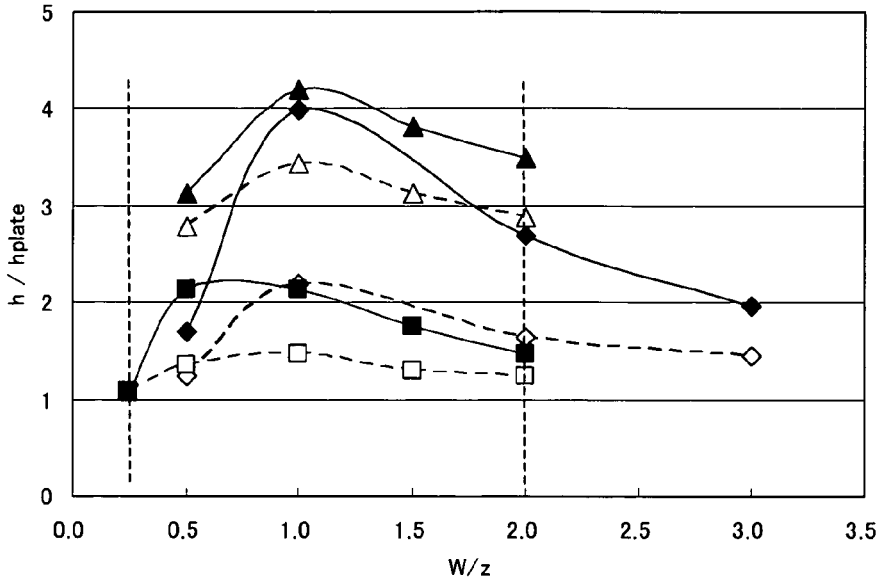
FIG. 7 is a graph showing a computation result of variations in improvement rate (h/hplate) of the heat transfer coefficient against an interval-to-wavelength ratio (W/z) with regard to various values of the Reynolds number Re.

The interval-to-wavelength ratio (W/z) represents a ratio of the folding interval W (see FIG. 1) of the folding lines, which are arranged along the main stream of the air flow to symmetrically fold back the continuous lines of the wave crests 34 and the continuous lines of the wave troughs 36 (shown by the one-dot chain lines and the two-dot chain lines), to a wavelength 'z' of the waveform including one wave crest 34 and one adjacent wave trough 36 (see FIG. 2). This is based on the computation result suggesting the high improvement rate (h/hplate) of the heat transfer coefficient 'h' of the fin 30 of the embodiment to the heat transfer coefficient 'hplate' of the flat plate fin of the comparative example in the interval-to-wavelength ratio (W/z) of greater than 0.25 and less than 2.0. FIG. 7 is a graph showing a computation result of variations in improvement rate (h/hplate) of the heat transfer coefficient against the interval-to-wavelength ratio (W/z) with regard to various values of the Reynolds number Re. The computation result of FIG. 7 suggests the high improvement rate (h/hplate) of the heat transfer coefficient in the interval-to-wavelength ratio (W/z) of greater than 0.25 and less than 2.0. As clearly understood from the graph of FIG. 7, the interval-to-wavelength ratio (W/z) is preferably in a range of greater than 0.25 and less than 2.0, more preferably in a range of greater than 0.5 and less than 2.0, and most preferably in a range of greater than 0.7 and less than 1.5 The wavelength 'z' of the waveform is not necessarily fixed but may be varied as long as the overall average of interval-to-wavelength ratio (W/z) satisfies Inequality (2) given above.

In the corrugated fin tube heat exchanger 20 of the embodiment, each fin 30 is designed to have a curvature radius-to-wavelength ratio (r/z) in a range of greater than 0.25 as shown by Inequality (3) given below:

$$0.25<r/z \quad (3)$$

Figure 8:
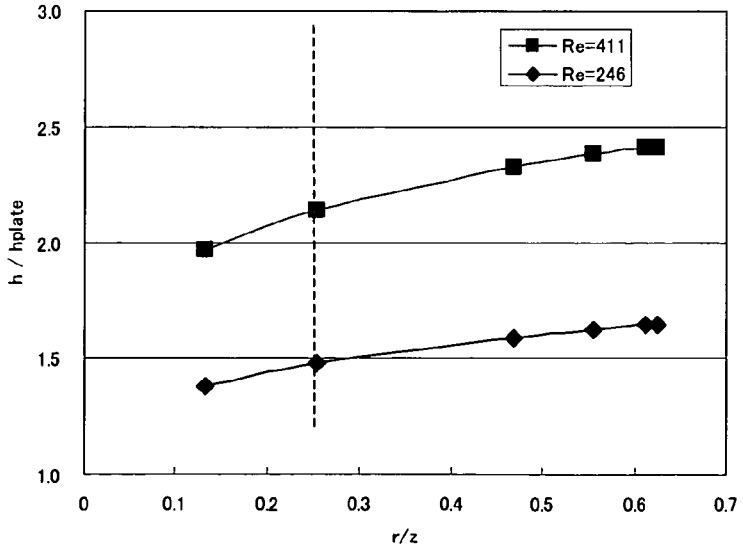
FIG. 8 is a graph showing a computation result of variations in improvement rate (h/hplate) of the heat transfer coefficient against a curvature radius-to-wavelength ratio (r/z) with regard to various values of the Reynolds number Re.

The curvature radius-to-wavelength ratio (r/z) represents a ratio of the radius of curvature 'r' at the top of the wave crest 34 or at the bottom of the wave trough 36 (see FIG. 2) to the wavelength 'z' of the waveform including one wave crest 34 and one adjacent wave trough 36. This is based on the computation result suggesting the high improvement rate (h/hplate) of the heat transfer coefficient 'h' of the fin 30 of the embodiment to the heat transfer coefficient 'hplate' of the flat plate fin of the comparative example in the condition of the curvature radius-to-wavelength range (r/z) of greater than 0.25. FIG. 8 is a graph showing a computation result of variations in improvement rate (h/hplate) of the heat transfer coefficient against the curvature radius-to-wavelength ratio (r/z) with regard to various values of the Reynolds number Re. The radius of curvature 'r' at the top of the wave crest 34 or at the bottom of the wave trough 36 relates to a local speed multiplication of the air flow running along the waveforms of the wave crests 34 and the wave troughs 36. Controlling such a local speed multiplication desirably prevents an increase of the ventilation resistance. There is accordingly an adequate range of the radius of curvature 'r'. The above range of the curvature radius-to-wavelength ratio (r/z) is given as the adequate range of the radius of curvature 'r' in relation to the wavelength 'z'. The computation result of FIG. 8 suggests the high improvement rate (h/hplate) of the heat transfer coefficient in the curvature radius-to-wavelength ratio (r/z) of greater than 0.25. As clearly understood from the graph of FIG. 8, the curvature radius-to-wavelength ratio (r/z) is preferably greater than 0.25, more preferably greater than 0.35, and most preferably greater than 0.5. The radius of curvature 'r' is not necessarily fixed but may be varied as long as the overall average of the curvature radius-to-wavelength ratio (r/z) satisfies Inequality (3) given above.

Figure 9:
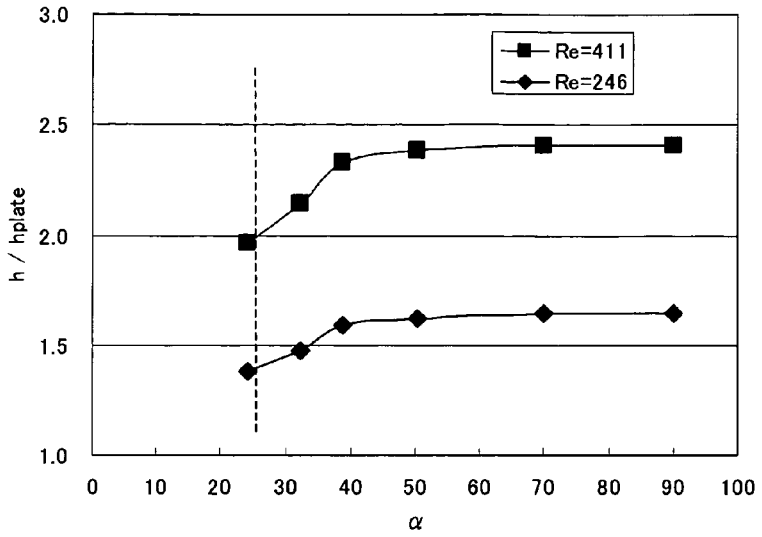
FIG. 9 is a graph showing a computation result of variations in improvement rate (h/hplate) of the heat transfer coefficient against an angle of inclination $\alpha$ with regard to various values of the Reynolds number Re.

In the corrugated fin tube heat exchanger 20 of the embodiment, the continuous lines of the wave crests 34 and the continuous lines of the wave troughs 36 formed on each fin 30 are arranged to have an angle of inclination α of not less than 25 degrees on the cross section of the waveform including one wave crest 34 and one adjacent wave trough 36 (see FIG. 2). This is based on the computation result suggesting the high improvement rate (h/hplate) of the heat transfer coefficient 'h' of the fin 30 of the embodiment to the heat transfer coefficient 'hplate' of the flat plate fin of the comparative example in the angle of inclination α of not less than 25 degrees. This condition increases the air flow along the waveforms of the wave crests 34 and the wave troughs 36 and thereby ensures effective generation of the secondary flows of the air having contribution to the heat transfer. FIG. 9 is a graph showing a computation result of variations in improvement rate (h/hplate) of the heat transfer coefficient against the angle of inclination α with regard to various values of the Reynolds number Re. The computation result of FIG. 9 suggests the high improvement rate (h/hplate) of the heat transfer coefficient in the angle of inclination α of not less than 25 degrees. As clearly understood from the graph of FIG. 9, the angle of inclination α is preferably not less than 25 degrees, more preferably not less than 30 degrees, and most preferably not less than 40 degrees.

As described above, in the corrugated fin tube heat exchanger 20 of the embodiment, each fin 30 is designed to have the continuous lines of the wave crests 34 and the continuous lines of the wave troughs 36 (respectively shown by the one-dot chain lines and the two-dot chain lines), which are arranged to have the preset angle γ (for example, 30 degrees) in the specific angle range of 10 degrees to 60 degrees relative to the main stream of the air flow and are folded back symmetrically about the folding lines of the preset interval (folding interval) W along the main stream of the air flow. This arrangement generates the effective secondary flows of the air and improves the heat transfer coefficient, thus enhancing the overall efficiency of heat exchange and allowing size reduction of the corrugated fin tube heat exchanger 20. Formation of the waveforms including the wave crests 34 and the wave troughs 36 on the fin 30 does not cause any partial cutting and folding of the fin 30 and does vary the interval between the adjacent fins 30. This arrangement effectively prevents separation of the air flow and a local speed multiplication of the air flow.

In the corrugated fin tube heat exchanger 20 of the embodiment, each fin 30 is designed to have the amplitude-to-pitch ratio (a/p) satisfying Inequality (1) given above. The amplitude-to-pitch ratio (a/p) represents the ratio of the amplitude 'a' of the waveform including one wave crest 34 and one adjacent wave trough 36 to the fin pitch 'p' or the interval between the adjacent fins 30. This arrangement ensures the high heat transfer coefficient of the corrugated fin tube heat exchanger 20 and thereby allows further size reduction of the corrugated fin tube heat exchanger 20.

In the corrugated fin tube heat exchanger 20 of the embodiment, each fin 30 is designed to have the interval-to-wavelength ratio (W/z) in the range of greater than 0.25 and less than 2.0 as shown by Inequality (2) given above. The interval-to-wavelength ratio (W/z) represents the ratio of the folding interval W of the folding lines arranged along the main stream of the air flow to symmetrically fold back the continuous lines of the wave crests 34 and the continuous lines of the wave troughs 36 to the wavelength 'z' of the waveform including one wave crest 34 and one adjacent wave trough 36. This arrangement ensures the high heat transfer coefficient of the corrugated fin tube heat exchanger 20 and thereby allows further size reduction of the corrugated fin tube heat exchanger 20.

In the corrugated fin tube heat exchanger 20 of the embodiment, each fin 30 is designed to have the curvature radius-to-wavelength ratio (r/z) in the range of greater than 0.25 as shown by Inequality (3) given above. The curvature radius-to-wavelength ratio (r/z) represents the ratio of the radius of curvature 'r' at the top of the wave crest 34 or at the bottom of the wave trough 36 (see FIG. 2) to the wavelength 'z' of the waveform including one wave crest 34 and one adjacent wave trough 36. This arrangement effectively controls a local speed multiplication of the air flow running along the waveforms of the wave crests 34 and the wave troughs 36 and thereby prevents an increase of the ventilation resistance. This improves the performance of the corrugated fin tube heat exchanger 20.

In the corrugated fin tube heat exchanger 20 of the embodiment, the continuous lines of the wave crests 34 and the continuous lines of the wave troughs 36 formed on each fin 30 are arranged to have the angle of inclination α of not less than 25 degrees on the cross section of the waveform including one wave crest 34 and one adjacent wave trough 36. This arrangement ensures the high heat transfer coefficient of the corrugated fin tube heat exchanger 20 and thereby allows further size reduction of the corrugated fin tube heat exchanger 20.

In the corrugated fin tube heat exchanger 20 of the embodiment described above, each fin 30 is designed to have the interval-to-wavelength ratio (W/z), which is given as the ratio of the folding interval W of the folding lines arranged along the main stream of the air flow to symmetrically fold back the continuous lines of the wave crests 34 and the continuous lines of the wave troughs 36 to the wavelength 'z' of the waveform including one wave crest 34 and one adjacent wave trough 36, in the range of greater than 0.25 and less than 2.0 as shown by Inequality (2) given above. In one modified structure, each fin 30 may be formed to have the interval-to-wavelength ratio (W/z) in the range of not greater than 0.25 or in the range of not less than 2.0.

In the corrugated fin tube heat exchanger 20 of the embodiment described above, each fin 30 is designed to have the curvature radius-to-wavelength ratio (r/z), which is given as the ratio of the radius of curvature 'r' at the top of the wave crest 34 or at the bottom of the wave trough 36 to the wavelength 'z' of the waveform including one wave crest 34 and one adjacent wave trough 36, in the range of greater than 0.25 as shown by Inequality (3) given above. In one modified structure, each fin 30 may be formed to have the curvature radius-to-wavelength ratio (r/z) in the range of not greater than 0.25.

In the corrugated fin tube heat exchanger 20 of the embodiment described above, the continuous lines of the wave crests 34 and the continuous lines of the wave troughs 36 formed on each fin 30 are arranged to have the angle of inclination $\alpha$ of not less than 25 degrees on the cross section of the waveform including one wave crest 34 and one adjacent wave trough 36. In one modified structure, each fin 30 may be formed to have the angle of inclination $\alpha$ of less than 25 degrees.

Figure 10:
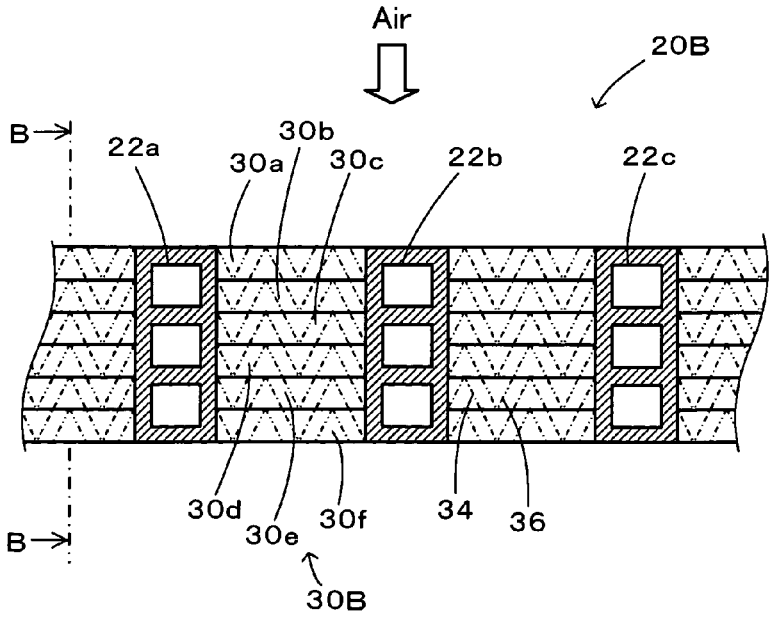
FIG. 10 is a schematic diagram illustrating the configuration of a corrugated fin tube heat exchanger 20B in one modified example.
Figure 11:
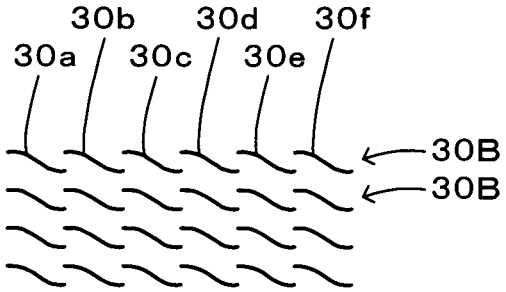
FIG. 11 is a sectional view showing a B-B cross section of the corrugated fin tube heat exchanger 20B of FIG. 10.

In the corrugated fin tube heat exchanger 20 of the embodiment, each fin 30 is made of a single plate member and is designed to have the continuous lines of the wave crests 34 and the continuous lines of the wave troughs 36, which are arranged at 30 degrees relative to the main stream of the air flow and are folded back symmetrically about the folding lines of the preset interval (folding interval) W along the main stream of the air flow. In a corrugated fin tube heat exchanger 20B of one modified example shown in FIGS. 10 and 11, each fin 30B consists of multiple fin members 30*a* to 30*f*, which are parted at multiple cross sections perpendicular to the direction of the air flow. FIG. 11 is a sectional view showing a B-B cross section of the corrugated fin tube heat exchanger 20B of the modified example shown in FIG. 10. Assembly of each fin 30B from the multiple fin members 30*a* to 30*f* parted along the direction of the air flow effectively prevents development of a temperature boundary layer at the cross sections of separation. Formation of the waveforms including the wave crests 34 and the wave troughs 36 generates the effective secondary flows of the air and thereby ensures the high heat transfer performance.

The corrugated fin tube heat exchanger 20 of the embodiment performs heat exchange between the air flow and the heat exchange medium flowing through the multiple heat transfer tubes 22*a* to 22*c*. In one modification, heat exchange may be performed between a fluid flow other than the air (for example, a liquid flow or a gas flow) and the heat exchange medium flowing through the multiple heat transfer tubes 22*a* to 22*c*.

The embodiment describes the corrugated fin tube heat exchanger 20 as one preferable mode of carrying out the invention. The technique of the invention is, however, not restricted to the corrugated fin tube heat exchangers but may be applied to cross fin tube heat exchangers. The principle of the invention is also applicable to a heat exchanger of a modified structure with omission of all the fins 30 from the corrugated fin tube heat exchanger 20 of the embodiment. The heat exchanger of this modified structure has multiple heat transfer tubes opposed to one another and designed to include heat transfer planes. The heat transfer plane of each heat transfer tube arranged to face an adjacent heat transfer tube is designed to have continuous lines of wave crests and continuous lines of wave troughs, which are arranged to have a preset angle in the specific angle range of 10 degrees to 60 degrees relative to the main stream of the air flow and are folded back symmetrically about folding lines of a preset interval along the main stream of the air flow. Namely the technique of the invention is applicable to a heat transfer plane of any heat transfer member satisfying the following conditions in a heat exchanger that performs heat exchange by making a fluid flow between at least two opposed heat transfer members. The heat transfer plane of the heat transfer member is arranged to form the pathway of the fluid flow and is designed to have continuous lines of wave crests and continuous lines of wave troughs, which are arranged to have a preset angle in a specific angle range of 10 degrees to 60 degrees relative to a main stream of the fluid flow and are folded back symmetrically about folding lines of a preset interval along the main stream of the fluid flow. A ratio of an amplitude of a waveform including one wave crest of a wave crest line and one wave trough of an adjacent wave trough line to an interval between the heat transfer planes of adjacent heat transfer members satisfies Inequality (1) given above.

The embodiment and its applications discussed above are to be considered in all aspects as illustrative and not restrictive. There may be many modifications, changes, and alterations without departing from the scope or spirit of the main characteristics of the present invention.

INDUSTRIAL APPLICABILITY

The present invention is preferably applied to the manufacturing industries of heat exchangers.

The invention claimed is:

1. A heat exchanger configured to perform heat exchange by making a fluid flow between at least two opposed heat transfer members, wherein each of the at least two opposed heat transfer members is structured to have a heat transfer plane to make the fluid flow thereon and equipped with wave crests and wave troughs formed on a predominant part of a surface of the heat transfer plane, the wave crests and the wave troughs having multiple continuous lines, and the multiple continuous lines of the wave crests and the multiple continuous lines of the wave troughs are alternately formed on the predominant part of the surface of the heat transfer plane, the wave crests and the wave troughs are formed by a curved surface, the wave crests and the wave troughs are arranged so that the multiple continuous lines of the wave crests and the multiple continuous lines of the wave troughs are formed in a V shape or multiple connected V shapes, wherein a pitch of wave of the wave crests and wave troughs in a direction perpendicular to a main stream of the fluid flow is non-constant, and wherein an apex of the V shape faces with the direction of the main stream of the fluid flow, with arms of the V shape extending in a direction opposite to the main stream of the fluid flow, with respect to the apex of the V shape, the wave crests and the wave troughs are arranged so that the main stream of the fluid flow is perpendicular to the multiple continuous lines of the wave crests and the multiple continuous lines of the wave troughs that are found in the V shape and so right and left diagonal lines of the V shape intersect with the main stream of the fluid flow in a specific angle range of 10 degrees to 60 degrees, and thereby secondary flow, different from the main stream of the fluid flow, that flows along the surface of the wave crests and the wave troughs is generated on the surface of the heat transfer plane, to generate the secondary flow effectively, the wave crests and the wave troughs being arranged to satisfy Inequality (1) given below:

$$1.3\times Re^{-0.5}<a/p<0.2 \quad (1)$$

where 'a' denote an amplitude of a waveform including one wave crest and one wave trough, 'p' denotes a pitch as an interval between adjacent heat transfer planes of the at least two opposed heat transfer members, and 'Re' denotes a Reynolds number defined by a bulk flow rate and the pitch 'p', each of the at least two opposed heat transfer members is structured to have the wave crest and the wave trough arranged to satisfy Inequality (2) given below:

$$0.25<W/z<2.0 \quad (2)$$

where 'W' denotes a folding interval of the V shape and 'z' denotes a wavelength of the waveform including the wave crest and the wave trough, and each of the at least two opposed heat transfer members are structured to have the wave crest and the wave trough arranged to satisfy Inequality (3) given below:

$$0.25<r/z \quad (3)$$

wherein 'r' denotes a radius of curvature at a top of the wave crest and/or at a bottom of the wave trough in the waveform and 'z' denotes the wavelength of the waveform including the wave crest and the wave trough.

2. The heat exchanger in accordance with claim 1, wherein the wave crest and the wave trough formed on each of the at least two opposed heat transfer members are arranged to have an angle of inclination of not less than 25 degrees on a cross section of the waveform including the wave crest and the wave trough.

3. The heat exchanger in accordance with claim 1, wherein each of the at least two opposed heat transfer members includes multiple heat transfer sectional members parted at plural planes substantially perpendicular to the main stream of the fluid flow.

4. The heat exchanger in accordance with claim 1, the heat exchanger comprising:

multiple heat transfer tubes arranged in parallel to one another as a pathway of a heat exchange medium, wherein the at least two opposed heat transfer members are formed as multiple fin members attached to the multiple heat transfer tubes such as to be arranged perpendicular to the multiple heat transfer tubes in a heat exchangeable manner and to be overlapped in parallel to one another at a preset interval.

5. The heat exchanger in accordance with claim 1, wherein the multiple continuous lines of the wave crests and the multiple continuous lines of the wave troughs are arranged to have the specific angle in the range of 25 degrees to 35 degrees relative to the main stream of the fluid flow.

6. The heat exchanger in accordance with claim 1, wherein the wave crests and the wave troughs satisfy Inequality given below:

$$1.3\times Re^{-0.5}<a/p<0.1.$$

7. A heat exchanger configured to perform heat exchange by making a fluid flow in a main flow direction from an inlet to an outlet of the heat exchanger between at least two opposed heat transfer members, the heat exchanger comprising:

the at least two opposed heat transfer members configured with a heat transfer plane that defines the fluid flow thereon and configured with wave crests and wave troughs, the wave crests and wave troughs having multiple continuous lines formed on the heat transfer plane and are arranged to have a preset angle in a specific angle range of 10 degrees to 60 degrees relative to the main flow direction from the inlet to the outlet, the wave crests and the wave troughs are formed by a curved surface, the multiple continuous lines of the wave crests and multiple continuous lines of the wave troughs are arranged to be bent multiple times to be symmetrically folded back about multiple folding lines arranged at a preset interval along the main flow direction, wherein a pitch of wave of the wave crests and wave troughs in a direction perpendicular to the main flow direction of the fluid flow is non-constant, a bend formed in the multiple continuous lines of the wave crests and multiple continuous lines of the wave troughs forms an apex that faces with the direction of the main flow direction, with arms of the apex extending in a direction opposite to the main flow direction, with respect to the apex of the bend, the multiple continuous lines of the wave crests and wave troughs meander back and forth so as to extend across the heat transfer members in a direction transverse to the main flow direction, and thereby secondary flow, different from the main flow direction of the fluid flow, that flows along the surface of the wave crests and the wave troughs is generated on the surface of the heat transfer plane, to generate the secondary flow effectively, the wave crests and the wave troughs being arranged to satisfy Inequality (1) given below:

$$1.3\times Re^{-0.5}<a/p<0.2 \quad (1)$$

where 'a' denote an amplitude of a waveform including one wave crest and one wave trough, 'p' denotes a pitch as an interval between adjacent heat transfer planes of the at least two opposed heat transfer members, and 'Re' denotes a Reynolds number defined by a bulk flow rate and the pitch 'p', each of the at least two opposed heat transfer members is structured to have the wave crest and the wave trough arranged to satisfy Inequality (2) given below:

$$0.25<W/z<2.0 \quad (2)$$

where 'W' denotes a folding interval of the V shape and 'z' denotes a wavelength of the waveform including the wave crest and the wave trough, and each of the at least two opposed heat transfer members are structured to have the wave crest and the wave trough arranged to satisfy Inequality (3) given below:

$$0.25<r/z \quad (3)$$

wherein 'r' denotes a radius of curvature at a top of the wave crest and/or at a bottom of the wave trough in the waveform and 'z' denotes the wavelength of the waveform including the wave crest and the wave trough.

8. The heat exchanger in accordance with claim 7, wherein the wave crests and the wave troughs satisfy Inequality given below:

$$1.3\times Re^{-0.5}<a/p<0.1.$$

* * * * *